US008986401B2

(12) United States Patent
Ford

(10) Patent No.: US 8,986,401 B2
(45) Date of Patent: Mar. 24, 2015

(54) HIGH LUBRICITY FUEL REFORMULATION TO INCREASE MILEAGE AND REDUCE EMISSIONS

(71) Applicant: Don Ricardo Oniel Ford, Claremont, CA (US)

(72) Inventor: Don Ricardo Oniel Ford, Claremont, CA (US)

( * ) Notice: Subject to any disclaimer, the term of this patent is extended or adjusted under 35 U.S.C. 154(b) by 0 days.

(21) Appl. No.: 13/946,905

(22) Filed: Jul. 19, 2013

(65) Prior Publication Data

US 2013/0298452 A1 Nov. 14, 2013

Related U.S. Application Data

(63) Continuation-in-part of application No. PCT/US2012/021930, filed on Jan. 19, 2012.

(51) Int. Cl.

| | |
|---|---|
| ***C10L 1/185*** | (2006.01) |
| ***C10L 1/188*** | (2006.01) |
| ***C10L 10/08*** | (2006.01) |
| ***C10L 1/18*** | (2006.01) |
| *C10L 1/182* | (2006.01) |
| *C10L 1/19* | (2006.01) |

(52) U.S. Cl.

CPC . *C10L 10/08* (2013.01); *C10L 1/18* (2013.01); *C10L 1/1822* (2013.01); *C10L 1/1824* (2013.01); *C10L 1/1852* (2013.01); *C10L 1/1857* (2013.01); *C10L 1/1881* (2013.01); *C10L 1/1905* (2013.01)

USPC ..... 44/446; 44/447; 44/448; 44/449; 44/451; 44/452

(58) Field of Classification Search

USPC ..... 44/446–449, 451, 452

See application file for complete search history.

(56) References Cited

U.S. PATENT DOCUMENTS

| | | | | |
|---|---|---|---|---|
| 3,035,948 | A | 5/1962 | Fox | |
| 4,294,585 | A | 10/1981 | Sung | |
| 4,376,635 | A | 3/1983 | Sung | |
| 4,482,352 | A | 11/1984 | Osgood et al. | |
| 8,696,769 | B2 * | 4/2014 | Ford | 44/446 |
| 2002/0072288 | A1 * | 6/2002 | Hei et al. | 442/59 |
| 2004/0107634 | A1 | 6/2004 | Binions | |

FOREIGN PATENT DOCUMENTS

| | | |
|---|---|---|
| CN | 1710036 | 12/2005 |
| JP | H10168464 | 6/1998 |

OTHER PUBLICATIONS

International Searching Authority, PCT, Written Opinion of the International Searching Authority, Sep. 26, 2012.

International Searching Authority, PCT, International Report on Patentability, Aug. 22, 2012.

* cited by examiner

*Primary Examiner* — Pamela H Weiss

(74) *Attorney, Agent, or Firm* — Gottlieb, Rackman & Reisman PC

(57) ABSTRACT

A fuel additive imparting high lubricity to gasoline and diesel fuels while concurrently increasing miles and reducing emissions. The fuel additive is formed of a plurality of individual components having individual and a combined synergistic effect along with components increasing fuel lubricity which are mixed with a liquid fuel-soluble carrier and added to the fuel supply of internal combustion engines.

2 Claims, 1 Drawing Sheet

Component Additive Concentrate:

| | |
|---|---|
| 36%-56 % | Acetophenone |
| 10%-15% | Diethylene ether |
| 8%-12 % | Dibutyl ether |
| 15%-17% | Ethylhexanol 2 |
| 6%-14.0 % | Ethylhexanoic Acid 2 |
| 1.5%-2.5% | Polyisobutylene |
| .5%-1.5% | Diethyl Phthalate |
| .5% -2% | Ethylcyclohexanol |
| .5%-1.5% | Diethyl Oxalate |

Component Additive Concentrate:

| | |
|---|---|
| 36%-56 % | Acetophenone |
| 10%-15% | Diethylene ether |
| 8%-12 % | Dibutyl ether |
| 15%-17% | Ethylhexanol 2 |
| 6%-14.0 % | Ethylhexanoic Acid 2 |
| 1.5%-2.5% | Polyisobutylene |
| .5%-1.5% | Diethyl Phthalate |
| .5% -2% | Ethylcyclohexanol |
| .5%-1.5% | Diethyl Oxalate |

Fig. 1

Fuel-Soluble Carrier

| | |
|---|---|
| 52%-57.00% | Organic or Synthetic Ethanol |
| 34%-38.00 % | Benzyl Alcohol |
| 8%-11% | Component Concentrate |

Fig. 2

HIGH LUBRICITY FUEL REFORMULATION TO INCREASE MILEAGE AND REDUCE EMISSIONS

This application is a Continuation In Part to International Filing PCT/US12/21930 filed Jan. 19, 2012, which claims priority to U.S. patent application Ser. No. 13/354,292 filed on Jan. 19, 2012, which is a nonprovisional application of U.S. Provisional Patent Application Ser. No. 61/461,525, filed on Jan. 19, 2011, all incorporated herein in their entirety by this reference thereto.

BACKGROUND OF THE INVENTION

1. Field of the Invention

The present invention relates to a fuel additive formed of a plurality of individual components having individual and a combined synergistic effect with hydrocarbon fuel commonly employed in internal combustion engines. Mixed with the fuel employed by an engine, the fuel and additive mixture results in an increase in available horsepower, improved torque, and reduced fuel consumption, all while concurrently causing a reduction in pollutants in the exhaust from the burned fuel.

2. Prior Art

The industrialized world has, in the last century, evolved to employ the internal combustion engine in a wide variety of circumstances, to produce power to provide the mechanical energy to do work. While the employment of internal combustion engines has significantly increased industrial output, eased the workload of millions of workers, and provided a means to replace stock animals and bulky steam engines and the like, with a dependable and moveable power source, it is not without detriment.

Internal combustion engines run, for the most part, on liquid fuels such as gasoline and diesel fuel which are primarily derived by the refinement of crude oil. The burning of such fossil fuels, and in particular crude oil derived vehicle fuels such as gasoline and diesel, provide an easily transportable reservoir of energy for a mobile engine.

However, the burning of fuel in such engines is never completely efficient. As a consequence of such inefficient combustion range, engines employing conventional gas and diesel fuel suffer from excess fuel consumption, engine knock, and carbon build up on valves, cylinder heads and pistons. Additionally, depending on the fuel and any government mandated mixtures, there can be wide variations in engine efficiency. Further, engines burning such fuels have exhaust which contribute pollutants and greenhouse gasses to the atmosphere such as NOx (oxides of Nitrogen), unburnt He (hydrocarbons), CO (Carbon Monoxide), $NO_2$ (nitrogen dioxide), NO (nitric oxide) and with diesel fuel there can be significant diesel particulate matter.

Much of these problems with conventional fuels can be attributed to inconsistent burning of the fuel in the cylinders as well as the effects of prior years of burning such fuels and the aforementioned engine deposits and wear therefrom.

In recent decades, many various fuel additives have been proposed and provided in attempts to improve fuel economy and reduce combustion exhaust pollutants. Such additives, however, must concurrently address the issues of unburnt fuel in the exhaust as well as partially burnt fuel, both of which impart pollution to the atmosphere.

Much prior art has taught and suggested adding various combustion enhancers for the various types of internal combustion engine fuels. There is a wide variance on the enhancements claimed and taught by such prior art additives which are provided in diverse forms but most are taught as being in either a liquid state mixed with liquid carriers and some are taught in a solid state to be mixed with fuels as directed.

Problems with both fuel combustion and lubricity have developed in recent years, especially since fuels have been refined to remove ever higher percentages of sulfur. The extra cracking process at refineries to do so tends to leave fuels dry or lacking in sufficient lubricity. This can have drastic effects upon vehicles running such fuels be they gas powered engines or diesel.

Diesel engines are particularly effected by excess refinement and removal of sulfur from fuels. The increased friction and wear over time can damage pistons, cylinders, fuel injectors, fuel pumps, and other very expensive components. This results in excess repairs and vehicle downtime in vehicles with diesel engines which have previously been known for longevity and reliability.

Gasoline fuels are also becoming subject to such restrictions on sulfur content, in more recent government efforts to curb exhaust pollution. A major issue is the effect of sulfur upon expensive exhaust catalytic converters and their life span and performance. The lubricity requirements of gasoline are generally lower than for diesel engines because gasoline fuel injection systems inject fuel to the cylinders at much lower pressures than diesel engines. But just as with diesel engines, failed pumps, hoses, and injectors, are expensive to repair. With ever more stringent government requirements, this can only get worse.

As such, there is a continuing and unmet need for an additive for fuel which will remedy the downside of modern fuels on gasoline and diesel engines. Such an additive in addition to providing improvements in burning of fuels during combustion, should also provide improvements to the lubricity of such fuels to minimize or eliminate the wear and tear caused by over refined fuels currently employed. Further, such an additive should be reasonably inexpensive and as such, have its expense offset by gains in mileage and performance which will lessen the cost of the fuel. Such an additive should provide a significant decrease in pollutants and dust in exhaust gases. Ideally, such an additive should save more in fuel and wear and tear over time, than the cost of the additive. Finally, such an additive should be easily mixed with fuel by normal users so as to allow widespread use.

Further while the prior art reveals numerous treatments for fuel, it does not disclose the unique combination of components to yield the component additive to hydrocarbon fuel herein, or teach their use in a synergistic combination for providing enhanced power extraction, lubricity, and concurrent pollutant reduction with engines employing such fuels.

SUMMARY OF THE INVENTION

As disclosed herein, there is a fuel additive composition for inclusion with a major amount of a hydrocarbon fuel such as gasoline or diesel fuel employed by vehicles worldwide, along with a minor amount of the disclosed additive fuel-soluble composition.

The disclosed additive invention provides an easy to employ treatment for hydrocarbon fuels such as gasoline and diesel fuel which improves the power output of the fuel and hence the mileage of a vehicle employing the treated fuel. Fuel enhanced with the additive composition herein, is better disbursed within cylinders by fuel injectors resulting in a much better combustion of the fuel. The result is a significant increase in mileage due to the better extraction of energy from the fuel in the enhanced combustion. Further, the additive composition provides a substantial improvement to lubricity without an attendant deterioration in engine performance. This lubricity enhancement results in much less wear and tear on engine components exposed to fuels over long periods of time and operation. Thus, the present invention improves power output and lubricity as compared to similar hydrocarbon fuels which have not been treated with the herein disclosed reaction products.

Still further, fuel treated with the disclosed additive composition herein, have a significant reduction in exhaust pollutants such as NOx (oxides of Nitrogen) previously unburnt He (hydrocarbons), CO (Carbon Monoxide), $NO_2$ (nitrogen dioxide), NO (nitric oxide), and when employed with diesel fuel, a reduction in DPM (diesel particulate matter) due to the more consistent uniform fuel burn.

The disclosed fuel additive can be employed in a number of ways. In one mode, it may be mixed with a carrier liquid which is combustible and soluble with either gasoline or diesel in concentrations adapted to treat an average tank of fuel such as 20-25 gallons. In another mode, such as for large trucks and construction and other equipment employing diesel engines, the additive composition can be held in auxiliary tanks which would add the mixture to fuel supplied to the engine in an ongoing fashion, thus alleviating the need to mix it with fuel in the tank or during fueling. In another mode, the additive composition can be mixed in a concentrated form and diluted with a proper amount of a liquid carrier such that it can be made when needed and stored in a smaller area than if already mixed with the carrier liquid.

In all modes, when mixed with fuels for internal combustion engines the disclosed additive composition acts to break up longer molecule chains forming the fuel. The resulting particles, formed by shorter molecular chains, have an increased surface area relative to the surface area of a longer chain. The larger relative surface area enables a better attraction of negatively charged oxygen molecules which produces a more efficient and complete combustion of the treated fuel once ignited. This efficient method of combustion increases horse power, reduces emissions of NOx (oxides of nitrogen), previously unburnt He (hydrocarbons), CO (Carbon Monoxide), $NO_2$ (nitrogen dioxide), NO (nitric oxide), DPM (diesel particulate matter) due to the more consistent uniform fuel burn. Thus, the treated fuel provides improved combustion on each engine combustion stroke resulting in both improved power and torque, and deceased fuel consumption. Additionally, the additive composition contains lubricity enhancers resulting in minimized wear and tear on fuel system components as well as better misting of the fuel within the cylinder upon injection from the smaller molecule chains and enhanced lubricity allowing for bond breaking in an easier fashion during injection.

With respect to the above description, before explaining at least one preferred embodiment of the herein disclosed invention in detail, it is to be understood that the invention is not limited in its application to the details of construction and to the mixtures and percentages in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for mixing and formulating other fuel additive compositions adapted for carrying out the several purposes of the present disclosed device. It is important, therefore, that the claims be regarded as including such equivalent construction and methodology insofar as they do not depart from the spirit and scope of the present invention.

It is an object of the present invention to increase fuel economy and reduce fuel consumption of internal combustion engines using fuel treated with the additive composition herein.

It is another object of this invention to reduce combustion emissions in gasoline and diesel powered internal combustion engines and consequently, reduce greenhouse gases vented in the exhaust of engines employing fuel treated herewith.

It is a further object of the present invention to provide fuel with increased lubricity and a resulting decrease in engine wear in gasoline and diesel internal combustion engines.

Further objects of the invention will be brought out in the following part of the specification, wherein detailed description is for the purpose of fully disclosing the invention without placing limitations thereon. The objects, advantages and embodiments of the present invention are described in the specification and those skilled in the art on reading such will surely discern previously undiscovered advantages and uses which will be obvious subsequent to reading the specification, claims, or from the practice of this invention. Therefore, it is understood that the invention as claimed and described or obvious after reading this disclosure, fall within the scope of the appended claims.

BRIEF DESCRIPTION OF DRAWING FIGURES

FIG. 1 shows a view of a table of the ingredients of the additive composition of a concentrate adapted for mixing in a fuel-soluble carrier.

FIG. 2 shows a table of mixture ingredients for the preferred fuel-soluble carrier.

DETAILED DESCRIPTION OF THE PREFERRED EMBODIMENTS OF THE INVENTION

As shown in the figures and described herein, the additive composition can be provided as a concentrate which may be later diluted using a fuel-soluble carrier or can be mixed with the fuel-soluble carrier and provided in a pre-mixed manner where it is placed in the fuel tank of the internal combustion engine.

As shown in FIG. 1, the component additive consists of a plurality of components mixed in ranges to achieve the concentrate additive mixture. The concentrate additive mixture is then mixed with the fuel-soluble liquid carrier in a ratio of between 9-11 percent of the concentrate to the total volume of the mixed concentrate and liquid carrier. For example between 9-11 ounces of the additive concentrate in a total volume mixture of additive concentrate and liquid carrier of 100 ounces.

Currently a 10 percent mixture of component additive concentrate is a favored mode of the additive invention which is mixed with a sufficient amount of the liquid carrier component to achieve a 10% by volume of additive to the total volume of the additive concentrate and carrier mix.

As shown in FIG. 1, the components of the component concentrate include as a percentage of the total volume of the component additive concentrate, from 36%-56% Acetophenone, from 10%-15% Diethylene ether, 8%-12% Dibutyl Ether, 15%-17% Ethylhexanol 2, 6%-14% Ethylhexanoic Acid 2, 1.5%-2.5% Polyisobutylene, 0.5%-1.5% Diethyl Phthalate, 0.5%-2% Ethyl cyclohexanol and 0.5%-1.5% Diethyl Oxalate.

Lubricity of the concentrate component additive is provided by the Polyisobutylene which can be treated with a conventional additive such as ZDDP to ensure a homogeneous mix with the other components, and 2,6-dimethyl cyclohexanol and Ethylcyclohexanol which in combination, depending on the intended use, may be increased or decreased in the noted ranges. An increase, for example, may be desired with a diesel fuel where gasoline is the intended fuel for the component additive. Also, for a mode of the component additive with substantial benefits, but where lubricity enhancement is not desired, these three components of the component additive may be deleted, although in most cases lubricity enhancement would be desirable.

The final mixture of additive concentrate, once achieved in the desired percentages of components, is to be diluted with a soluble carrier, to render the amount of the component additive concentrate to be 9%-11% by volume of the total volume of the mixed component additive concentrate and the liquid carrier, with 10% being a current favored amount.

The liquid carrier for the concentrate, is preferably the components noted in FIG. 2 of 52%-57% of Organic or Synthetic Alcohol such as Ethanol 200 or SDA-3-A and 34%-38% Benzyl Alcohol as total respective percentages of the volume of the liquid carrier. A mid range of both percentages of both carrier components is currently preferable. However, it can be mixed to the noted higher or lower limits by volume and achieve exceptional results.

In use, the component additive with liquid carrier mixed to the noted percentages by volume, is added to the fuel tank of a vehicle preferably at the rate of one ounce to 10 gallons of fuel for diesel engines and one ounce to 10-15 gallons of fuel for gasoline for gasoline engines. The component additive concentrate can be provided in volume and diluted in the fuel tank or fuel line in an ongoing fashion using onboard reservoirs of the concentrate and the carrier to conserve on space and provide the benefits in volume. Or, the component additive concentrate can be provided to local distributors who mix it in the proper volume relative to the liquid carrier to which it is mixed to achieve the fuel tank ready mixture. Finally, the component additive concentrate and carrier can be mixed in proper percentages of total volume, and then placed in containers for use by vehicle owners who would add it to their fuel tank.

Testing of the component additive invention herein has shown that engines having the additive mixed with running fuel in the noted ratio have decreased emissions in the exhaust and increased power with resulting mileage. Damage to components usually suffering from modern fuel lubricity problems have been significantly reduced or eliminated. Consequently, the addition of the component additive to the fuel of vehicles is calculated to save money over time with increased fuel efficiency and reduced costs for fuel as well as fewer repairs to the fuel and combustion systems of the engine.

The additive composition herein described and disclosed has been in relation to ratios based on volume. It is readily apparent that ratios may be equally well determined on a weight basis or a volume to weight basis and such is anticipated.

While all of the fundamental characteristics and features of the invention have been shown and described herein, this invention is susceptible to considerable variation in its practice by those skilled in the art. Therefore the foregoing description is not intended to limit in any fashion, and should not be construed as limiting the invention to the particular exemplifications presented herein. Rather, what is intended to be covered is as set forth in the ensuing claims and the equivalents thereof permitted as a matter of law. Patentee does not intend to dedicate any disclosed embodiments to the public, and to the extent any disclosed modifications or alterations may not literally fall within the scope of the claims, they are considered to be part of the invention under the doctrine of equivalents.

Further, with reference to particular embodiments herein, a latitude of modification, various changes and substitutions are intended in the foregoing disclosure and it will be apparent that in some instances, some components of the additive of the invention may be employed without a corresponding use of others without departing from the scope of the invention as set forth. It should also be understood that various substitutions, modifications, and variations may be made by those skilled in the art, such as substituting the named compound with one from the same chemical group with similar reactive characteristics, without departing from the spirit or scope of the invention. Consequently, all such modifications and variations and substitutions as would occur to those skilled in the art herein, and especially in the art of chemistry, are included considered to be also included within the scope of the invention as defined by the following claims.

What is claimed is:

1. A component fuel additive comprising:

a first component of said additive including a mix by total volume of 36%-56% Acetophenone, 10%-15% Diethylene ether, 8%-12% Dibutyl Ether, 15%-17% Ethylhexanol 2, 6%-14% Ethylhexanoic Acid 2, and 0.5%-1.5% Diethyl Oxalate;

a second component comprising a mixture by total volume of 52%-57% Organic or Synthetic Ethanol and 34%-38% Benzyl Alcohol; and a mixture of having first portion comprising said first component, and having a second portion comprising said second component, said mixture forming a total volume of said fuel additive; and in said mixture forming said fuel additive, 9%-11% of said total volume of said fuel additive being comprised of said first component.

2. The component fuel additive of claim 1, additionally comprising:

said first portion of said mixture forming said fuel additive having additional mixture components, said extra mixture components in percentages of said mix by total volume of said first component, including 1.5%-2.5% Polyisobutylene, 0.5%-1.5% Diethyl Phthalate, and 0.5%-2% Ethylcyclohexanol.

* * * * *